US007172036B2

(12) United States Patent
Jacobs et al.

(10) Patent No.: US 7,172,036 B2
(45) Date of Patent: Feb. 6, 2007

(54) SOIL SAMPLE CONTAINMENT DEVICE AND METHOD

(75) Inventors: Lloyd E. Jacobs, Green Bay, WI (US); David E. Turriff, Green Bay, WI (US); John F. Schabron, Laramie, WY (US); Susan S. Sorini-Wong, Laramie, WY (US); Thomas M. Christy, Salina, KS (US)

(73) Assignees: En Novative Technologies, Inc., Green Bay, WI (US); Kejr, Inc., Salina, KS (US)

( * ) Notice: Subject to any disclaimer, the term of this patent is extended or adjusted under 35 U.S.C. 154(b) by 215 days.

(21) Appl. No.: 10/456,800

(22) Filed: Jun. 6, 2003

(65) Prior Publication Data

US 2004/0035607 A1 Feb. 26, 2004

Related U.S. Application Data

(60) Provisional application No. 60/387,041, filed on Jun. 6, 2002.

(51) Int. Cl.
*E21B 49/02* (2006.01)

(52) U.S. Cl. ..... 175/20; 175/58; 175/226; 73/864.51; 73/864.91

(58) Field of Classification Search ..... 175/20, 175/58, 308, 226, 249; 73/864.51, 964.91, 73/863; 206/305, 524.1
See application file for complete search history.

(56) References Cited

U.S. PATENT DOCUMENTS

| | | | | |
|---|---|---|---|---|
| 3,077,979 | A * | 2/1963 | Jones et al. | 206/523 |
| 4,156,469 | A * | 5/1979 | Laskey | 175/58 |
| 4,336,849 | A * | 6/1982 | Hug | 175/246 |
| 4,587,857 | A * | 5/1986 | Bush | 73/863 |
| 4,750,570 | A * | 6/1988 | Barrett | 175/4 |
| 4,982,615 | A * | 1/1991 | Sultan et al. | 73/864.51 |
| 5,307,884 | A * | 5/1994 | Millgard | 175/20 |
| 5,343,771 | A | 9/1994 | Turriff et al. | 73/864.44 |
| 5,454,020 | A * | 9/1995 | Solazzi | 378/45 |
| 5,505,098 | A | 4/1996 | Turriff et al. | 73/864.44 |
| 5,937,953 | A | 8/1999 | Melberg et al. | 175/20 |
| 6,098,724 | A * | 8/2000 | Ricker | 175/20 |
| 6,125,948 | A * | 10/2000 | David et al. | 175/58 |
| 6,772,651 | B2 * | 8/2004 | Scott et al. | 73/864.91 |

* cited by examiner

*Primary Examiner*—Kenneth Thompson
(74) *Attorney, Agent, or Firm*—Jeffrey L. Thompson; Thompson & Thompson, P.A.

(57) ABSTRACT

A soil sample containment device is provided which allows soil samples to be contained within individual sections of a soil sampler liner. The device includes first and second end caps for covering and sealing the respective ends of the soil sampler liner section. Each end cap has a structure for coupling with the opposite end cap for securing the end caps together. The coupling structure for each end cap includes a hook arm and an eye arm. The hook arm of the first end cap can be coupled with the eye arm of the second end cap to secure the end caps together over the ends of the liner section. A flexible sealing material is provided within each end cap for providing a compression seal between the end caps and the liner section. The liner sections can be formed of different lengths and different materials to accommodate different soil tests.

26 Claims, 4 Drawing Sheets

20
28
16, 17
23
29
25
21
22
26

21
16, 17
29
22

21
28
22
A
A
29
20
16, 17

22
20
16, 17

SOIL SAMPLE CONTAINMENT DEVICE AND METHOD

RELATED APPLICATIONS

This application claims priority of U.S. Provisional Application No. 60/387,041 filed on Jun. 6, 2002.

BACKGROUND OF THE INVENTION

1. Field of the Invention

The present invention relates generally to devices for obtaining soil samples from below the surface of the ground. In particular, the present invention relates to soil sample containment devices used to protect soil samples after the samples are collected by a soil sampling system.

2. Description of the Related Art

Soil sampling systems are commonly used to obtain soil samples from below the surface of the ground. The collected soil samples are used to determine soil conditions prior to construction, to locate mineral deposits, to study chemical dissipation and residue, to determine the concentration of environmental contaminants, to investigate hazardous waste sites, and in other ways well known in the art.

Unfortunately, the equipment and methodology for collecting and preserving soil samples do not allow for consistent and accurate soil analysis. It is common practice to retrieve a soil sample from the subsurface via a soil sampler, remove the soil sample from the soil sampler, and place the sample in a separate container. During this process, the handling and exposure of the soil sample increases the loss of contaminants which may be contained within the soil sample.

For accurate soil analysis, it is important that the sample be collected without disruption of the soil structure, that the sample not be subsampled, and that the sample is sealed in a manner to prevent leaks of contaminants around the seal. This is particularly difficult when soil is being tested for contamination by volatile organic compounds (VOC) because the VOCs tend to volatilize when exposed to air. The sample should be isolated from air to maintain substantially the same level and type of contamination as when the sample was first cored from the earth. The ideal soil sample is one that is representative of its origin in the subsurface.

There is a need in the industry for an improved soil sample containment device that eliminates the handling and exposure of soil samples in the field, and better maintains the integrity of the soil sample.

SUMMARY OF THE INVENTION

An object of the present invention is to provide an improved soil sample containment device and method that overcome the problems and shortcomings of the prior art.

A further object of the present invention is to provide an improved soil containment device that can be used effectively to preserve soil samples with minimal handling and disturbance, and that is economical to manufacture and easy to use.

A further object of the present invention is to provide a soil containment system that allows soil samples to be sealed and maintained within individual liner sections of a soil sampler liner without requiring subsampling.

A further object of the present invention is to provide an improved soil sampler liner that includes a plurality of liner sections having different lengths and/or materials corresponding to particular tests to be performed.

In order to accomplish these and other objects of the invention, a soil sample containment device is provided that can be used to seal and maintain soil samples within individual liner sections of a soil sampler liner. The containment device has first and second end caps for covering respective ends of a soil sampler liner section. A sealing means is associated with each of the end caps for sealing the respective ends of the liner section with a compression seal. The sealing means is preferably a flexible sealing material which is compressed by the end caps against the ends of the liner section. A structure, such as a hook and eye coupler, secures the end caps together when they are assembled over a soil sampler liner section to maintain the compression seal.

According to another aspect of the present invention, a soil sampler liner for use in a soil sampling system is provided with first and second liner sections made of different materials. The first liner section is made of a first material (e.g., plastic) compatible with a first test to be performed, while the second liner section is made of a second material (e.g., metal) compatible with a second test to be performed.

According to another aspect of the present invention, a soil sampler liner for use in a soil sampling system is provided with first and second liner sections having different volumes (lengths) for collecting different masses of soil. The first liner section has a first volume corresponding to an amount of soil to be used in a first test to be performed, while the second liner section has a second volume corresponding to an amount of soil to be used in a second test to be performed.

Numerous other objects of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

A soil sample containment device 10 according to a preferred embodiment of the present invention will now be described with reference to FIGS. 1 to 9 of the accompanying drawings.

Figure 1:
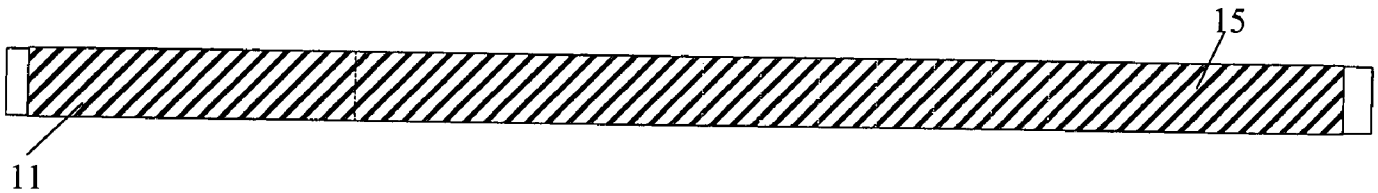
FIG. 1 is a side view of a complete soil sampler liner with a shrink wrap covering.
Figure 2:
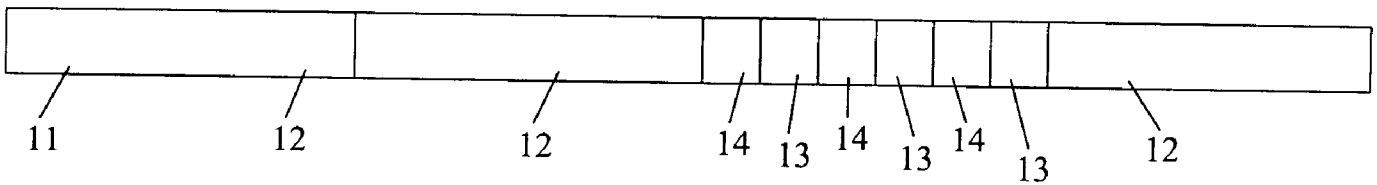
FIG. 2 is a side view of the soil sampler liner shown in FIG. 1 with the shrink wrap covering removed.
Figure 3:
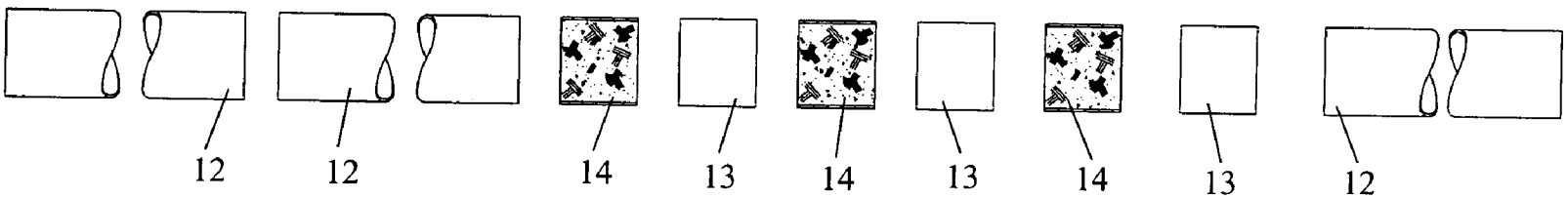
FIG. 3 is an exploded side view showing the individual sections of the soil sampler liner of FIG. 2.
Figures 4, 5, 6, 7:
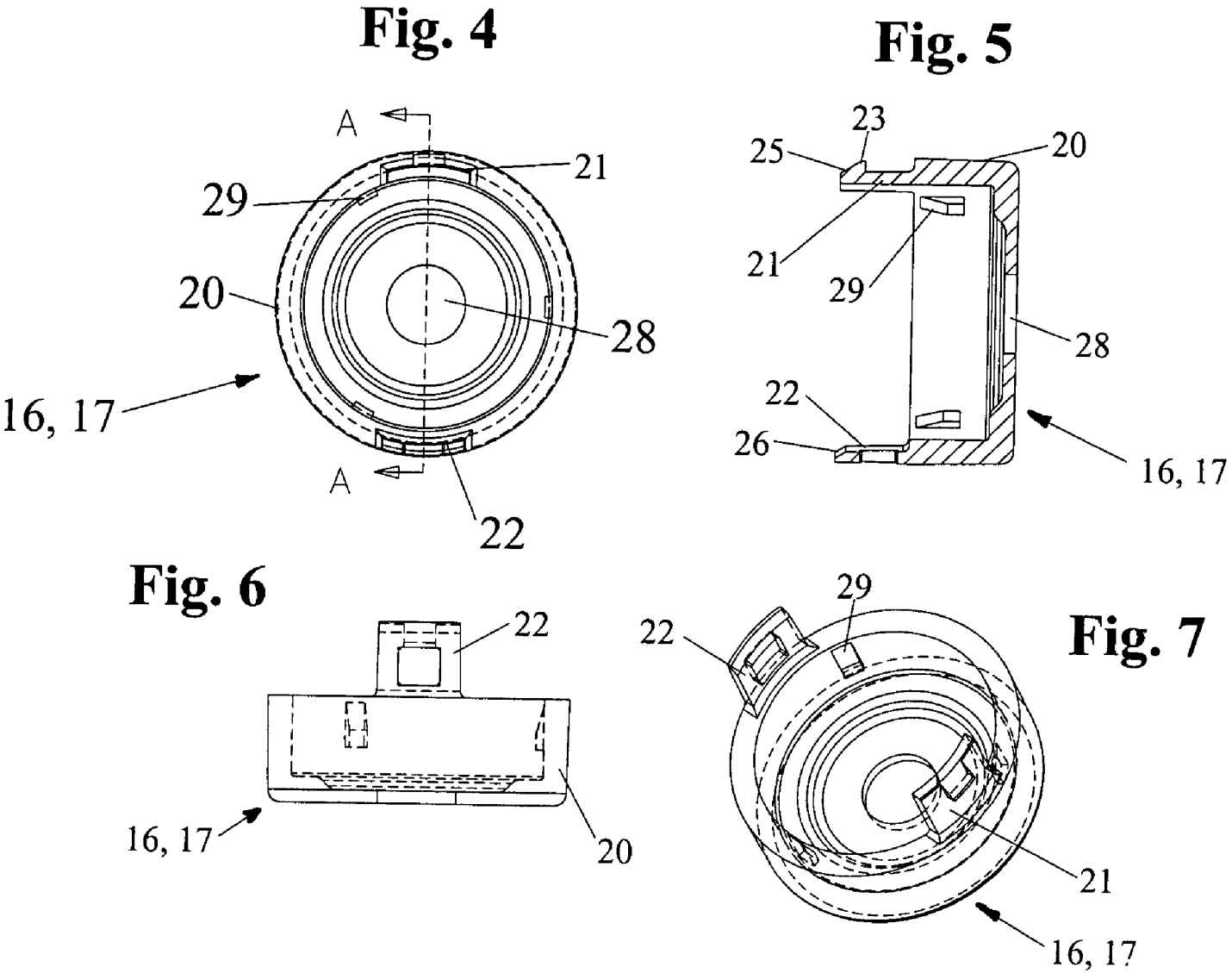
FIG. 4 is a plan view of an end cap of the soil sample containment device of the present invention.
FIG. 5 is a cross section view of the end cap taken along line A—A in FIG. 4.
FIG. 6 is a side view of the end cap.
FIG. 7 is a perspective view of the end cap.
Figure 8:
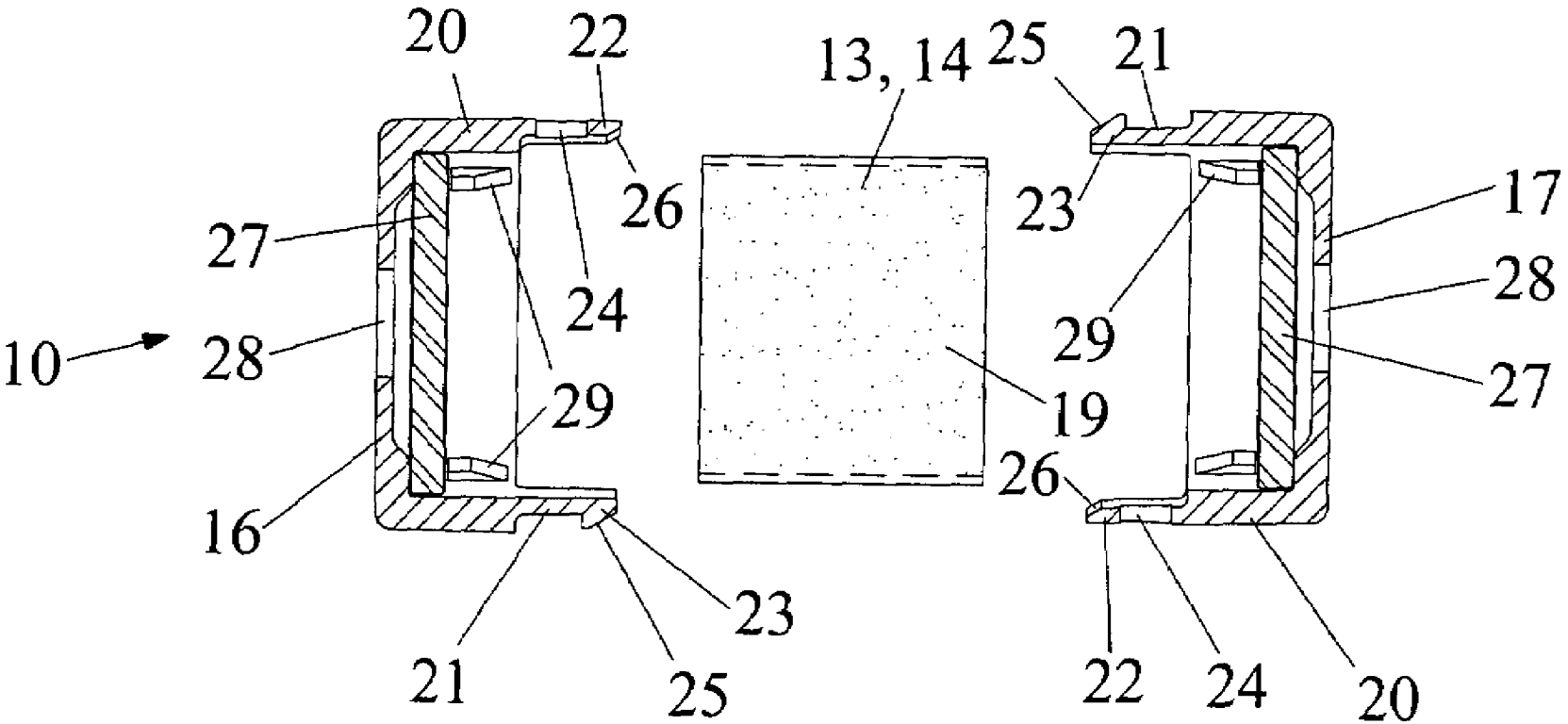
FIG. 8 is a side view of the soil sample containment device of the present invention before the end caps are assembled over the soil sampler liner section.
Figure 9:
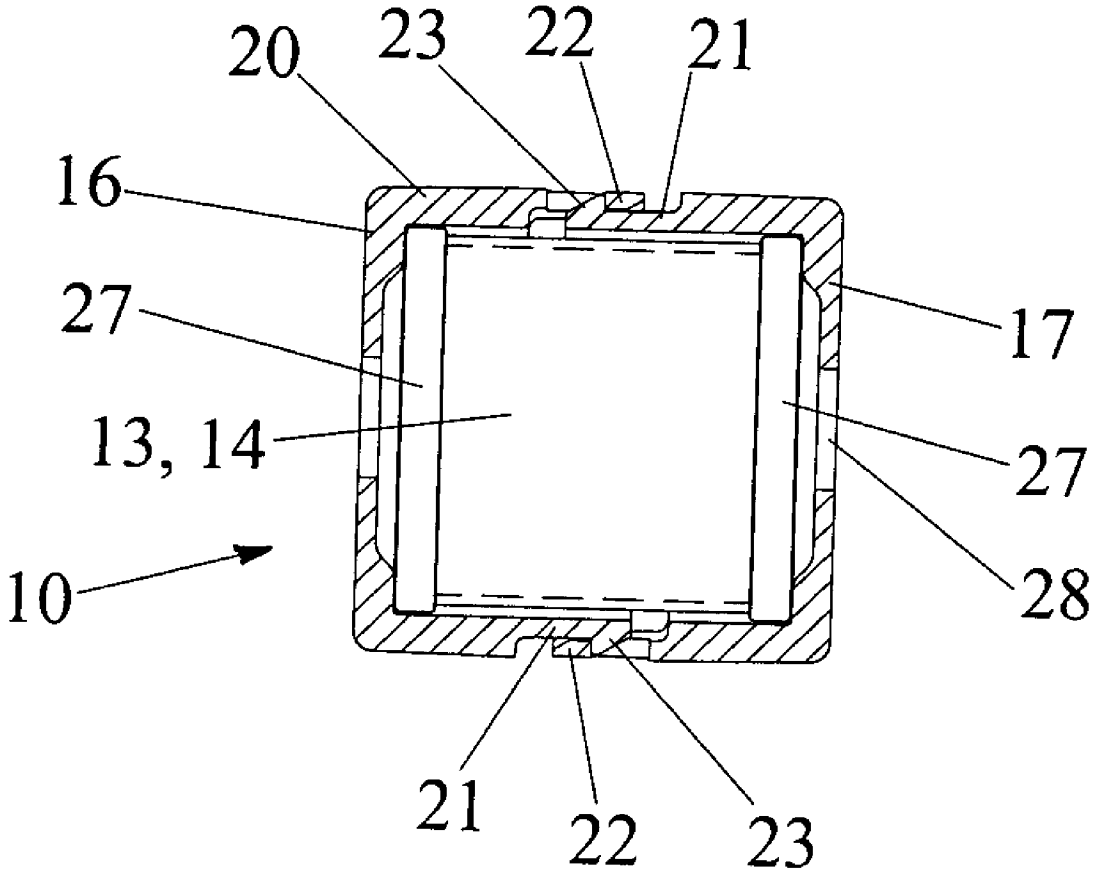
FIG. 9 is a side view of the soil sample containment device with the end caps assembled over the soil sampler liner section.

The soil sample containment device 10 of the present invention is used in conjunction with a soil sampling system having a soil sampler liner 11. The soil sampler liner 11 has several sections 12, 13, 14 of cylindrical tubing sections, as shown in FIGS. 1 to 3. In the preferred embodiment, some of the lining sections 12, 13 are metal and some of the lining sections 14 are plastic. An array of the liner sections are assembled end-to-end and held together with a shrink-wrap covering 15.

The short plastic sections 14 are transparent and allow the soil sample to be viewed before the soil sampler liner 11 is disassembled. The ability to view the soil sample allows the user to avoid areas in the soil sample that may contain voids or other unwanted media in the sample. It also allows the user to observe possible changes in soil type or strata before disassembling the soil sampler liner 11. The use of both plastic and metal liner sections is also advantageous because they allow a wider variety of standard tests to be performed on the sampled soil. For example, if the soil is being tested for contamination by heavy metals or other metallic contaminants, the sample often cannot be stored in a metal container prior to testing. Similarly, a plastic container cannot be used to store soil samples prior to certain other types of testing.

The complete soil sampler liner 11 is made up of a series of long soil sampler liner sections 12 and shorter soil sampler liner sections 13, 14. The shorter liner sections 13, 14, for example, can be 1 inch in length to hold approximately 25 grams of soil, or 1.25 inches in length to hold approximately 30 grams of soil. These particular sizes correspond with the soil mass requirements used in most soil tests performed in the United States. The American Society for Testing and Materials (ASTM), the U.S. Environmental Protection Agency (US EPA), and other federal and state governing bodies have adopted various standard soil tests that typically require a certain mass (e.g., 25 or 30 grams) of soil to be used to conduct the tests. Other countries, such as Japan, have adopted different standards for testing that call for different masses of soil (e.g., 50 grams). With the present invention, the liner sections 13, 14 can be sized to provide a particular volume that corresponds with the desired mass of soil called for by a particular test.

A combination of liner sections 12–14 can be used such that, when assembled, the combined length of the liner sections 12–14 corresponds with the length of the soil sampler being used (e.g., 24", 36", 48", etc.). The use of both short and long liner sections 12–14 allows for many soil sampler liner combinations.

The soil containment device 10 includes first and second locking end caps 16, 17 for covering and sealing the respective ends 18, 19 of a single soil sampler liner section 13, 14. Each end cap 16, 17 has a cylindrical portion 20 with a coupling structure comprising two locking arms 21, 22 extending from an outer circumference. The cylindrical geometry of the locking end caps 16, 17 accommodates the cylindrical soil sampler liner section 13, 14.

The two locking arms 21, 22 include a single hook arm 21 and a single eye arm 22. The hook arm 21 of the first end cap 16 can be coupled with the eye arm 22 of the second end cap 17, and vice versa, to secure the end caps 16, 17 together over the ends 18, 19 of the liner section 13, 14. The hook arm 21 of each end cap 16, 17 has a wedge-shaped hook 23 protruding outwardly from its outer surface. When assembled, the wedge-shaped hook 23 is held in an outward fashion by the outer surface of the soil sampler liner section 13, 14 to prevent inadvertent removal of the locking end caps 16, 17 from the soil sampler liner section 13, 14.

The eye arm 22 of each end cap 16, 17 has one or two eyes or rectangular-shaped holes 24 that receive the wedge-shaped hook 23 of the hook arm 21 of the opposing end cap 16, 17. Multiple eyes or holes 24 in the eye arm 22 can be used to accommodate soil sampler liner sections 13, 14 having different lengths, such as 1 inch and 1.25 inch lengths. The ends 25, 26 of the eye arm 22 and the hook arm 21 are chamfered such that the arms 21, 22 slide past one another rather than butt up to one another during assembly.

A flexible sealing material 27 is positioned within each end cap 16, 17 for providing a compression seal over a respective end 18, 19 of a soil sampler liner section 13, 14. The flexible sealing material 27, also referred to as a "septum," preferably comprises a silicone substrate and a thin Teflon™ coating. The coupling structure provided by the arms 21, 22 of the end caps 16, 17 is such that a predictable spacing will exist between the end caps 16, 17 when they are assembled over a liner section 13, 14 and coupled together (using a properly selected eye opening 24 if multiple openings are provided in the eye arm 22). As a result, the end caps 16, 17 can be made to properly compress the flexible sealing material 27 over the ends of the soil sampler liner section 13, 14 with a highly predictable amount of compression.

The construction of the hook arms 21 and the eye arms 22 is such that the flexible sealing material 27 will not be over compressed or under compressed, thereby improving the integrity of the sample. Research by the Applicants has shown that under compression of the sealing material 27 does not create an adequate seal, while over compression can cause the sealing material 27 to be ruined and become difficult to secure. The latching mechanism provided by the hook arms 21 and the eye arms 22 has been designed to apply a designated predetermined loading to the sealing material 27. When the user inserts the latching mechanism to its proper end point, achieving closure, the compressable sealing material 27 is placed under the correct loading against the end 18, 19 of the liner section 13, 14 to achieve the desired compression seal.

Other flexible materials or combinations of flexible materials can also be used for the sealing material 27 as long as they create a flexible and nonpermeable compression seal with the ends 18, 19 of the soil sample liner section 13, 14. As used in this application, the phrase "compression seal" means any seal created by compressing one member against another member in a manner sufficient to prevent loss of volatiles from a soil sample. Other forms of compression seals, such as annular sealing rings, can be used instead of the septa described above.

Each end cap 16, 17 includes a relief opening 28 to allow for any small protrusions at the ends of the soil sample. The relief opening 28 allows the flexible sealing material 27 to flex outwardly and accommodate any protrusions without compromising the sealing effect of the device.

Each end cap 16, 17 also includes a plurality of centering tabs 29 to center a soil sampler liner section 13, 14 within the cylindrical portion 20 of the end cap 16, 17. The centering tabs 29 are tapered at their leading edges to guide the ends of the liner section 13, 14 into a centered position.

The first and second end caps 16, 17 have a substantially identical structure and can be interchanged end-to-end when being assembled over a soil sampler liner section 13, 14. This allows a single inventory of end caps 16, 17 to be used and eliminates any hassle of having to find a male component to match a female component, and so forth.

In operation, the soil sample containment device 10 of the present invention is assembled by placing two locking end caps 16, 17 over the respective ends 18, 19 of a soil sampler liner section 13, 14 and fastening or snapping the hook arms 21 together with the opposing eye arms 22. This assembly seals both ends of the soil sampler liner section 13, 14, thereby preventing loss of the soil sample or contaminants contained within the soil sample. To disassemble the soil sample containment device 10, both eye arms 22 on the locking caps 16, 17 must be physically pulled outward to uncouple from the wedge-shaped hooks 23 of the hook arms 21 and thereby release the locking coupling structure of the end caps 16, 17.

An important advantage of the soil containment device 10 of the present invention over other related devices is the relationship between the soil sampler liner 11 and the locking end caps 16, 17. Other soil sample containers require excessive exposure and handling of the soil sample before it is actually sealed within a soil sample container. The present invention eliminates a substantial amount of the exposure and handling. In addition, the locking mechanism of the locking end caps 16, 17 essentially guarantees that the soil sample integrity will be preserved until the soil sample containment device 10 is disassembled.

Another important advantage of the soil containment device 10 of the present invention is that the soil sampler liner sections can be made in appropriate lengths to provide a volume of soil that corresponds closely with the mass required for a particular soil test. As a result, the invention eliminates the time consuming and expensive step of subsampling (i.e., collecting a small soil sample from a larger soil sample) within the laboratory to obtain the desired mass of soil for a particular soil test.

A method of containing soil samples using the soil containment device 10 described above will now be explained. The method uses a soil sampler liner assembly having at least one liner section, and preferably uses the soil sampler liner assembly 11 having a plurality of liner sections 13, 14. A soil sample is collected within the liner sections 13, 14 in a known manner using a soil sampling system, for example, that drives a soil sampler into the subsurface. The soil sampler liner assembly 11 is then removed from the soil sampling system and cut apart to separate the individual liner sections 13, 14 from each other. The liner sections 13, 14 (or at least one of them) are then sealed at their respective ends by end caps that form compression seals at the ends of the liner section, as described above, to prevent loss of volatiles from the soil sample. At least one of the liner sections has a predetermined volume corresponding to a mass of soil required for a standard test. As a result, substantially all of the soil sample from this liner section can be extruded in the laboratory for the test without subsampling.

It will be appreciated that certain features of the present invention described above can be changed without departing from the scope of the invention. For example, the soil sampler liner 11 may incorporate a core catcher or soil check valve to assist in sampling soil from the subsurface. Also, different sizes of soil sampler liner sections 12–14 and locking end caps 16, 17 may be developed. Also, structures other than the mating hook and eye structures of the preferred embodiment can be used to couple the end caps 16, 17 together. For example, an external lever or screw clamp separate from the end caps themselves can be used to secure the end caps together over the ends of the liner section.

While the invention has been specifically described in connection with specific embodiments thereof, it is to be understood that this is by way of illustration and not of limitation, and the scope of the appended claims should be construed as broadly as the prior art will permit.

What is claimed is:

1. A soil sample containment device, comprising:

first and second end caps for covering respective ends of a soil sampler liner section; and sealing means associated with the end caps for sealing respective ends of the liner section with a compression seal to prevent loss of volatiles from a soil sample contained within the liner section;

further comprising a means for securing the end caps together when assembled over a soil sampler liner section to maintain the compression seals at the ends of the liner section;

wherein said sealing means comprises a flexible sealing material positioned within each end cap for providing a seal over a respective end of the soil sampler liner section.

2. The soil sample containment device according to claim 1, wherein said means for securing the end caps together comprises multiple latching points to accommodate soil sampler liner sections of different lengths.

3. The soil sample containment device according to claim 1, wherein said end caps each comprises a hook arm and an eye arm as said means for securing the end caps together, and the hook arm of the first end cap can be coupled with the eye arm of the second end cap to secure the end caps together.

4. The soil sample containment device according to claim 3, wherein the hook arm of each end cap has a wedge-shaped hook protruding therefrom.

5. The soil sample containment device according to claim 4, wherein the eye arm of each end cap has at least one hole that accepts the hook protruding from the hook arm of the other end cap.

6. The soil sample containment device according to claim 5, wherein the ends of the eye arm and the hook arm are chamfered such that the arms slide past one another rather than butt up to one another during assembly.

7. The soil sample containment device according to claim 5, wherein the eye arm has a plurality of holes that accept the hook protruding from the hook arm of the other end cap to accommodate soil sampler liner sections of different lengths.

8. The soil sample containment device according to claim 1, wherein said sealing means comprises a flexible sealing material positioned within each end cap for providing a seal over a respective end of the soil sampler liner section.

9. A soil sample containment device, comprising:

first and second end caps for covering respective ends of a soil sampler liner section; and sealing means associated with the end caps for sealing respective ends of the liner section with a compression seal to prevent loss of volatiles from a soil sample contained within the liner section;

wherein said sealing means comprises a flexible sealing material positioned within each end cap for providing a seal over a respective end of the soil sampler liner section; and wherein each end cap includes a relief opening to allow the flexible sealing material to accommodate protrusions of a soil sample without compromising the sealing effect of the device.

10. A soil sample containment device, comprising:

first and second end caps for covering respective ends of a soil sampler liner section; and sealing means associated with the end caps for sealing respective ends of the liner section with a compression seal to prevent loss of volatiles from a soil sample contained within the liner section;

wherein each end cap includes a plurality of centering tabs to center a soil sampler liner section within the end cap.

11. The soil sample containment device according to claim 1, wherein the first and second end caps have a substantially identical structure and can be interchanged end-to-end when being assembled over a soil sampler liner section.

12. A soil sample containment device, comprising:

a soil sampler liner section obtained from a soil sampler liner assembly having multiple liner sections;

first and second end caps for covering respective ends of said soil sampler liner section; and sealing means associated with the end caps for sealing said respective ends of the liner section with a compression seal to prevent loss of volatiles from a soil sample contained within the liner section;

further comprising a means for securing the end caps together when assembled over said soil sampler liner section to maintain the compression seals at the ends of the liner section.

13. The soil sample containment device according to claim 12, wherein the means for securing the end caps together comprises a coupling structure which couples the end caps together and accommodates different lengths of soil sampler liner sections.

14. The soil sample containment device according to claim 12, wherein said sealing means comprises a flexible sealing material positioned within each of the end caps, and wherein said means for securing the end caps together compresses the flexible sealing material over the ends of the soil sampler liner section with a predictable amount of compression to form a nonpermeable seal.

15. The soil sample containment device according to claim 12, wherein the means for securing the end caps together includes a hook arm and an eye arm, and wherein the hook arms each include a wedge-shaped hook protruding outwardly which is held in an outward fashion by the soil sampler liner section to prevent inadvertent removal of the end caps from the soil sampler liner section.

16. A soil sampler liner for use in a soil sampling system, comprising:

a first liner section made of a first material which is compatible with a first test to be performed; and a second liner section made of a second material which is compatible with a second test to be performed, wherein said first material is different from said second material, and wherein said first and second liner sections are arranged end-to-end for direct contact with soil in a soil sampling system.

17. The soil sampler liner according to claim 16, wherein said first material is transparent.

18. The soil sampler liner according to claim 16, wherein said first material is plastic.

19. The soil sampler liner according to claim 18, wherein said second material is metal.

20. A soil sampler liner for use in a soil sampling system, comprising:

a first liner section having first and second open ends, an inner bore extending between said first and second ends, and a first volume corresponding to an amount of soil to be used in a first test to be performed; and a second liner section having first and second open ends, an inner bore extending between said first and second ends, and a second volume corresponding to an amount of soil to be used in a second test to be performed, wherein said first volume is different from said second volume, and wherein the inner bore of said first liner section is open and aligned with the inner bore of said second liner section.

21. The soil sampler liner according to claim 20, wherein one of said first and second liner sections has a volume corresponding to approximately 25 grams of soil.

22. The soil sampler liner according to claim 20, wherein one of said first and second liner sections has a volume corresponding to approximately 30 grams of soil.

23. The soil sampler liner according to claim 20, wherein one of said first and second liner sections has a volume corresponding to approximately 50 grams of soil.

24. A method of containing soil samples, comprising the steps of:

providing a soil sampler liner assembly having at least one liner section;

collecting a soil sample within said liner section; and placing first and second end caps over the ends of the liner section and forming a compression seal at each end of the liner section using a flexible sealing material positioned within each end cap for providing a seal over a respective end of the soil sampler liner section to prevent loss of volatiles from the soil sample; and securing the first and second end caps together to maintain the compression seals at the ends of the liner section.

25. The method according to claim 24, wherein said liner section has a volume corresponding to a mass of soil required for a standard test, and further comprising the step of extruding substantially all of the soil sample from the liner section for said test without subsampling.

26. A method of containing soil samples, comprising the steps of:

providing a soil sampler liner assembly having at least one liner section;

collecting a soil sample within said liner section; and placing first and second end caps over the ends of the liner section and forming a compression seal at each end of the liner section to prevent loss of volatiles from the soil sample;

wherein said soil sampler liner assembly has a plurality of liner sections, and further comprising the steps of:

collecting soil samples in a plurality of said liner sections; and placing end caps over the ends of each of the liner sections and forming compression seals at the ends of each of the liner sections to prevent loss of volatiles from each of the collected soil samples.

* * * * *